US009683785B2

(12) United States Patent
Tandon

(10) Patent No.: US 9,683,785 B2
(45) Date of Patent: Jun. 20, 2017

(54) HEAT EXCHANGER

(71) Applicant: Waterco Limited, Rydalmere (AU)

(72) Inventor: Pradeep Kumar Tandon, Rydalmere (AU)

(73) Assignee: Waterco Limited, Rydalmere (AU)

( * ) Notice: Subject to any disclaimer, the term of this patent is extended or adjusted under 35 U.S.C. 154(b) by 245 days.

(21) Appl. No.: 14/403,627

(22) PCT Filed: Mar. 22, 2013

(86) PCT No.: PCT/AU2013/000289

§ 371 (c)(1),
(2) Date: Nov. 25, 2014

(87) PCT Pub. No.: WO2014/000017

PCT Pub. Date: Jan. 3, 2014

(65) Prior Publication Data

US 2015/0136368 A1 May 21, 2015

(30) Foreign Application Priority Data

Jun. 29, 2012 (CN) ..... 2012 2 0315707 U
Oct. 5, 2012 (MY) ..... PI 2012004453

(51) Int. Cl.
*F28D 7/02* (2006.01)
*F28F 21/06* (2006.01)
(Continued)

(52) U.S. Cl.
CPC ..... *F28D 7/022* (2013.01); *F28D 7/024* (2013.01); *F28D 7/106* (2013.01); *F28D 7/14* (2013.01);
(Continued)

(58) Field of Classification Search
CPC ..... F28D 7/024; E04H 4/129; F16L 23/10
(Continued)

(56) References Cited

U.S. PATENT DOCUMENTS 3,696,636 A 10/1972 Mille
3,802,499 A * 4/1974 Garcea ..... F28D 7/024 165/154
(Continued)

FOREIGN PATENT DOCUMENTS

JP 63-217192 A 9/1988
WO 2011/038105 A2 3/2011

OTHER PUBLICATIONS

International Search Report issued in corresponding application No. PCT/AU2013/000289 on Jun. 5, 2013.
(Continued)

*Primary Examiner* — Allen Flanigan
(74) *Attorney, Agent, or Firm* — Carter, DeLuca, Farrell & Schmidt, LLP

(57) ABSTRACT

A heat exchanger includes a housing and a fluid flow conduit located within a cavity formed in the housing, the fluid flow conduit including an outer tube located adjacent to an inner wall of the housing and an inner tube in fluid communication with the outer tube, the inner tube being located between the outer tube and a longitudinal axis of the housing. An inlet port is located on the housing, the inlet port being in fluid communication with the cavity. The heat exchanger includes an outlet port located on the housing, the outlet port being in fluid communication with the cavity.

14 Claims, 9 Drawing Sheets

(51) Int. Cl.
*F28F 9/013* (2006.01)
*F28D 7/10* (2006.01)
*F28D 7/14* (2006.01)

(52) U.S. Cl.
CPC ..... *F28F 9/0132* (2013.01); *F28F 21/06* (2013.01); *F28F 2275/085* (2013.01); *F28F 2280/00* (2013.01)

(58) Field of Classification Search
USPC ..... 62/238.6; 165/156, 163
See application file for complete search history.

(56) References Cited

U.S. PATENT DOCUMENTS 4,462,220 A 7/1984 Iannelli
4,872,503 A * 10/1989 Marriner ..... F24F 12/006 165/160
4,907,418 A * 3/1990 DeFazio ..... E04H 4/129 165/159
5,379,832 A 1/1995 Dempsey
5,845,704 A 12/1998 Lavelle et al.
6,076,597 A * 6/2000 Manning et al. ..... F28D 7/024 165/163
6,293,335 B1 * 9/2001 Tawney et al. ..... F28D 7/022 165/155
6,499,534 B1 12/2002 Tawney et al.
7,261,149 B2 * 8/2007 Nail ..... F28D 7/022 165/159
7,597,136 B2 * 10/2009 Kite et al. ..... F28D 7/024 165/154
2002/0074111 A1 * 6/2002 Seeger et al. ..... F28D 7/024 165/163
2008/0093844 A1 * 4/2008 Casey, Sr. et al. ..... F16L 23/22 285/135.2
2008/0264617 A1 10/2008 Martin et al.
2010/0096115 A1 4/2010 Erickson
2010/0181045 A1 * 7/2010 Bognarne Fejes ..... F28D 7/024 165/67
2011/0289905 A1 12/2011 Acre et al.
2011/0303400 A1 * 12/2011 Scearce ..... F28D 9/0012 165/164

OTHER PUBLICATIONS

International Preliminary Report on Patentability issued in corresponding application No. PCT/AU2013/000289 on Oct. 16, 2014.
Supplementary European Search Report for corresponding European Application No. 13809578 dated Dec. 22, 2015.

* cited by examiner

HEAT EXCHANGER

FIELD OF THE INVENTION

The present invention relates to a heat exchanger. In particular, the present invention relates to a heat exchanger for heating water. The heat exchanger has particular application in the heating of swimming pools and spas, although it will be appreciated that it can be readily used in other applications across diverse industries.

BACKGROUND OF THE INVENTION

Heat exchangers are used to transfer heat from a heat source or thermal mass into a fluid mass, such as the water in a swimming pool or spa. Heat exchangers can be used for example to either raise or lower the temperature of a fluid, for various applications, such as heating or cooling, and heat exchangers are used in various industrial applications such as automotive, air conditioning, power generation and shipping among others.

One application in which heat exchangers are suitable is in a heating system for a swimming pool which uses a heat pump system to maintain a warm temperature of the pool. The heat pump extracts heat from surrounding air and transfers it to the body of water in the pool.

Heat pump generally use less energy compared to gas or electric heaters to transfer heat to a body of water. Heat pumps transfer heat by circulating a substance called a refrigerant through a cycle of evaporation and condensation wherein the refrigerant alternately absorbs, transports, and releases heat during the cycle. The refrigerant absorbs heat from the surrounding air and it evaporates. The heated refrigerant is then compressed and channeled to the apparatus where it condenses and releases the heat it has absorbed to the body of water.

Conventional heat exchangers include housings that are typically constructed as one-piece housings whereby once the internal components are installed inside the housing, the housing is sealed permanently to prevent water leakage during usage. Typically the housing is manually sealed through a plastic welding process. Therefore in the event of any damage or malfunction of the internal components, the whole heat exchanger is typically replaced.

Disadvantageously, unsealing the housing may damage the housing, such that cleaning, servicing or replacing the internal components is generally not feasible with existing swimming pool heat exchangers.

The housing of existing heat exchangers used for heating swimming pools is typically constructed from Engineering Plastic such as glass reinforced polypropylene which provides lower heat and chemical resistance. To construct the housing, individual parts of the housing are machined and subsequently attached together, for example, with plastic welding to define a complete unit. This construction process is relatively labour intensive and is still prone to leakage as the precision of the sealing may not be standardized. Copper based materials are typically utilised for the coil inside existing heat exchangers. However, on account of direct contact with the pool water, the copper based materials are susceptible to corrosion. Over time, chemicals present in the water will react with the coil, corroding and scaling the same, which may significantly reduce the life of the heat exchanger.

Liquid to liquid heat exchangers are often designed in the form of shell and tube heat exchangers. The heat exchange ability of such heat exchangers is a function of various parameters such as the length of the tubes, the flow rate of the two liquids and the material properties of the tubes.

One problem with existing heat exchangers is that they are often thermally inefficient, in the sense that it is difficult to extract a large percentage of the available thermal energy from the working fluid. This inefficiency is a result of various factors. One factor being that the two fluids of the heat exchanger are normally not in direct contact with each other, so the thermal properties of the individual components of the heat exchanger limit the thermal efficiency of the system.

In addition, in water heating applications for example, the high and low temperature fluids are only exposed to each other for a finite period of time, and this also limits the amount of thermal energy transfer that can take place within the heat exchanger.

OBJECT OF THE INVENTION

It is an object of the present invention to substantially overcome or at least ameliorate one or more of the above disadvantages, or at least to provide a useful alternative.

SUMMARY OF THE INVENTION

In a first aspect, the present invention provides a heat exchanger comprising:

- a housing;
- a fluid flow conduit located within a cavity formed in the housing, the fluid flow conduit including an outer tube located adjacent to an inner wall of the housing and an inner tube in fluid communication with the outer tube, the inner tube being located between the outer tube and a longitudinal axis of the housing;
- an inlet port located on the housing, the inlet port being in fluid communication with the cavity; and
- an outlet port located on the housing, the outlet port being in fluid communication with the cavity.

The outer tube preferably defines a first helix extending generally co-axially with the longitudinal axis and the inner tube defines a second helix also extending generally co-axially with the longitudinal axis.

The heat exchanger further preferably comprising a flow guide located between the inner tube and the longitudinal axis of the housing, the flow guide being adapted to agitate water flowing between the inlet port and the outlet port.

The flow guide preferably includes an elongate cylindrical member having a textured outer surface.

The outer surface preferably includes a plurality of annular ribs or a helical rib.

The cylindrical member is preferably hollow and includes a plurality of apertures for permitting drainage of water.

The heat exchanger further preferably comprises a plurality of longitudinally extending ribs or grooves formed on the inner wall of the housing.

The housing preferably includes a first section and a second section that are selectively detachable relative to each other.

The first and second sections preferably each include an annular flange, the annular flange including a first side having an annular groove and an opposing second side having an inclined surface.

The housing preferably includes a removable clamp for securing the first section to the second section.

The clamp preferably has a generally U-shaped profile, defining two inclined arms, each arm being adapted to engage with one of said annular flange inclined surfaces, further wherein the clamp is adjustable to pull the first and second sections together to compress a gasket or O-ring.

The housing is preferably manufactured from a glass fibre polypropylene (GFPP).

The clamp includes two band portions which are preferably securable together with fasteners.

The fluid flow conduit is preferably manufactured from titanium.

The housing includes one or more apertures for receiving a temperature and/or pressure sensor.

The flow guide preferably includes two stems which are located at opposing ends of the flow guide, each stem including a first engagement formation for engaging with a corresponding second engagement formation formed in the housing.

The first and second engagement formations are preferably corresponding male and female spline connections.

In a second aspect, the present invention provides a heat exchanger comprising:

a housing;

a fluid flow conduit located within a cavity formed in the housing, the fluid flow conduit including a first helical tube extending generally co-axially with a longitudinal axis of the housing, and a second helical tube also extending generally co-axially with the longitudinal axis, the second helical tube being located between the first helical tube and the longitudinal axis;

an inlet port located on the housing, the inlet port being in fluid communication with the cavity; and an outlet port located on the housing, the outlet port being in fluid communication with the cavity, wherein the housing includes a first section and a second section that are selectively detachable relative to each other to provide access to the cavity.

The first section preferably includes a first circumferential flange and the second section preferably includes a second circumferential flange, the first and second flanges being securable with a clamp.

The first and second circumferential flanges preferably include inclined opposing surfaces, adapted to engage with corresponding inclined surfaces of the clamp.

The heat exchanger preferably further comprises at least one damping means located between the inner wall of the housing and the outer tube.

The damping means preferably includes an engagement formation adapted to engage with the inner wall, further wherein there are three or more damping means spaced around a circumference of the cavity.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 1:
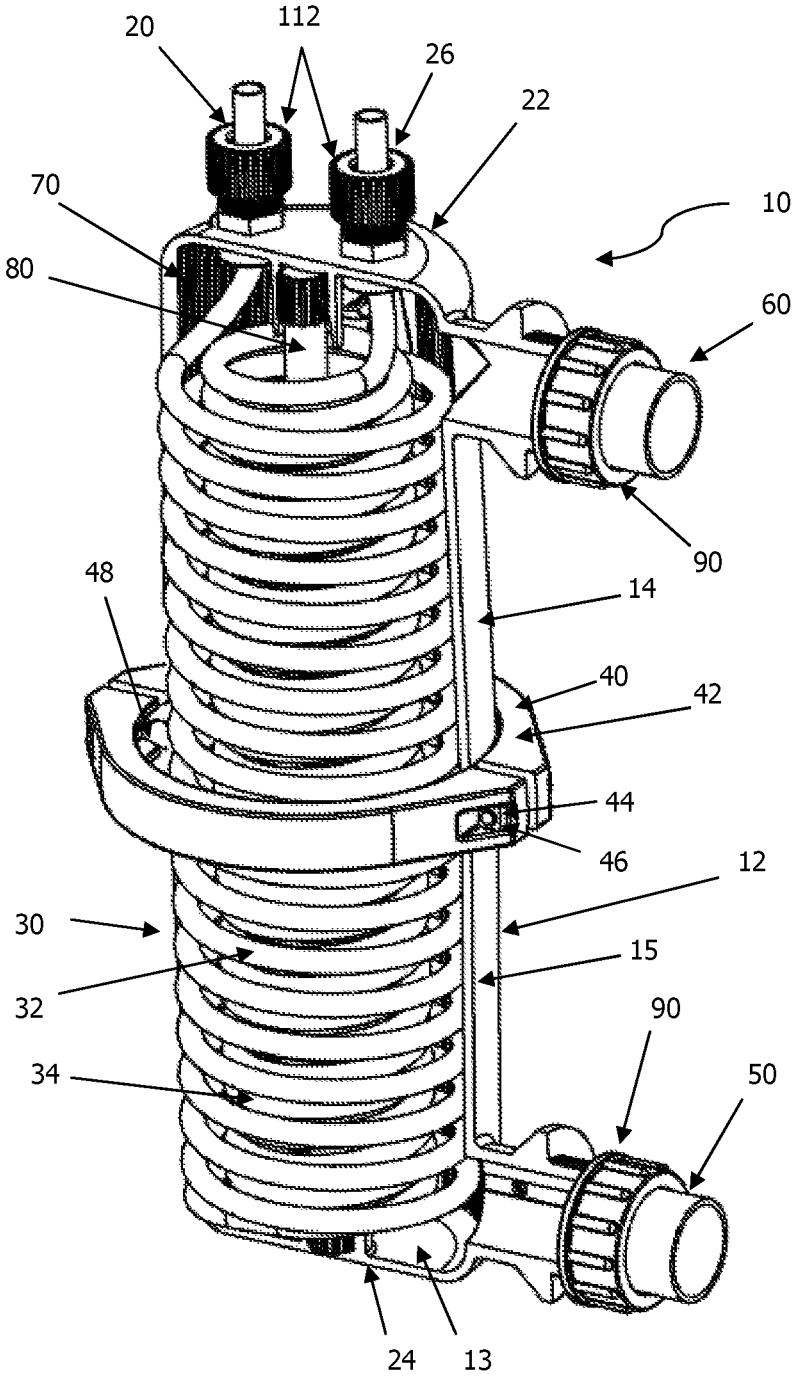
FIG. 1 is a perspective partial cross-sectional view of a heat exchanger.

A heat exchanger 10 is depicted in the drawings. The heat exchanger 10 is used in combination with a heat pump for a swimming pool or spa. However, it will be appreciated by those skilled in the art that the heat exchanger 10 can be used in numerous other applications. The heat exchanger 10 has an outer housing or casing 12, which defines a central cavity 13. The outer casing 12 is formed from two separate injection moulded plastic halves 14, 15. As depicted in FIG. 1, the two casing halves 14, 15 are shown in cross-section.

The heat exchanger 10 includes an inlet 20 for receiving heated working fluid, which may be water, refrigerant or another suitable working fluid. The inlet 20 is coupled to a source of heated working fluid. For example, this may be a roof mounted solar panel water heater, or a gas water heating system or a heat pump. The inlet 20 is fluidly connected to an internal coolant conduit in the form of a coil tube 30.

In a preferred embodiment, the coil tube 30 is manufactured from titanium, or another metal or metal alloy having high thermal conductivity properties. Titanium provides inert and robust properties and has a longer life expectancy compared to other typical coil materials such as copper. Advantageously, titanium provides enhanced protection against erosion and corrosion from chlorinated water, ozone, iodine, bromine and salt water.

Alternatively, the coil tube 30 can be manufactured from a copper base coil which is alloyed or coated with another corrosion resistant material such as nickel, iron, or manganese.

In the embodiment of the heat exchanger 10 depicted in the drawings, the coil tube 30 includes two coils. However, the coil tube 30 may include additional coils, for example three (3) or four (4) tubes defining a series of internal coils and an external coil that are arranged co-axially in relation to each other, and wherein the internal coils are surrounded by the external coil.

As depicted in the embodiment of FIG. 1, the coil tube 30 is a double helical coil arrangement, having an outer helix or coil 32 and a co-axial inner helix or coil 34. The outer coil 32 extends helically from the inlet 20, located at a proximal end 22 of the heat exchanger 10, to a distal end 24 of the heat exchanger 10. The outer coil 32 is located adjacent to the inner wall of the casing 12.

At the distal end 24, the outer coil 32 diverts radially inwardly and defines the starting portion of the inner coil 34, which is located within the outer coil 32. The inner coil 34 extends helically upwardly, through the casing 12 to a working fluid outlet port 26. The outlet port 26 returns the working fluid to the heat source, for reheating after heat exchange.

The heat exchanger 10 includes a locking means in the form of a clamp 40 which secures the two halves 14, 15 of the casing 12 together. The clamp 40 is formed by two corresponding generally semi-annular clamp members 42. Each clamp member 42 has a semi-circular cut-out, corresponding generally in size to the outer radius of the clamped portion of the outer casing 12.

The clamp members 42 each have a hole 44 formed on each side to receive a screw or bolt 46. Two bolts 46 are used to provide a clamping force to pull the two casing halves 14, 15 towards each other, to generate a fluid tight seal.

Figure 7:
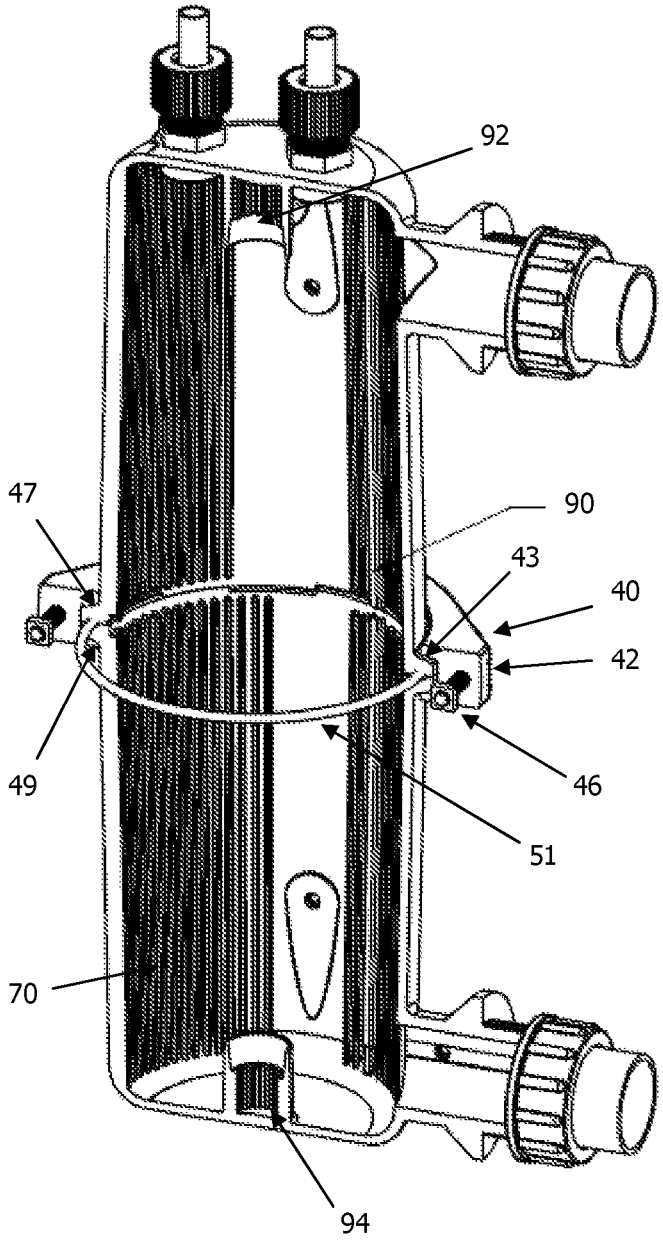
FIG. 7 is a perspective cross-sectional view depicting half of the heat exchanger casing of FIG. 1.

Referring to FIG. 7, the clamp members 42 each have a generally U-shaped cross-section include two inclined arms or sidewalls 43, which together define a generally U-shaped annular groove or channel 45.

Also referring to FIG. 7, the moulded plastic halves 14, 15 each includes a flange 47. The flanges 47 each have an inclined surface 49, adapted to mate with the inclined side wall 43 of the clamp members 42. An opposing side of each flange 47 includes a semi-circular annular groove adapted to receive an O-ring 51. Accordingly, by tightening the bolts 46, the inclined side walls 43 of the clamp members 42 apply a force against the inclined surfaces 49 of the flanges 47. This acts to compress the O-ring 51, resulting in a liquid tight seal between the two halves 14, 15 of the casing 12.

The moulded plastic halves 14, 15 of the casing 12 are selectively separable and are attached and secured using the clamp 40 in the manner described above. The clamp 40 permits quick disassembly and reassembly of the casing 12 for maintenance or repair purposes. When installed around the housing 12, the clamp 40 secures the casing 12 and prevents leakage.

Servicing or cleaning of the coil tube 30 or other internal components can be performed by disassembling the casing 12 by simply unlocking the clamp 40. Advantageously, the clamp 40 can be removed relatively quickly compared to other means such as a flange and gasket which typically require a large number of screws.

The casing 12 and clamp 40 are manufactured using a precision moulding process. The casing 12 is preferably made of 15% GFPP (glass fibre polypropylene), whilst the clamp 40 is preferably made of 30% GFPP. This assists the casing 12 and the clamp 40 to be stable in terms of dimensions and resistance to chemicals and heat at high temperature. Advantageously, the heat exchanger 10 is durable and easy to assemble without the need for any further machining processes.

The polymeric components of the heat exchanger 10, such as the casing 12, are impervious to rust, corrosion and deterioration. This allows the heat exchanger 10 to be used in various applications at different temperatures.

The precision moulding process generally produces components of consistent quality whereby each part, section and area of the components such as grooves and threads are formed with precision. This permits suitable connections between the heat exchanger 10 and other related components such as the double row coil and the exterior piping that is to be connected to the heat exchanger 10.

The heat exchanger 10 includes a cold water inlet 50. The cold water inlet 50 is located at the distal end 24 of the heat exchanger 10, furthest from the working fluid inlet 20, such that the heat exchanger 10 is a counter-flow heat exchanger 10, whereby the liquids/fluids enter the exchanger from opposing ends. The cold water inlet 50 is designed to receive water from the swimming pool or spa.

As shown in FIG. 1, the casing 12 is formed generally in a cylindrical shape, and the cold water inlet 50 and heated water outlet 60 protrude from the casing 12, and are located at opposing ends of the casing 12.

The external surfaces of the cold water inlet 50 and heated water outlet 60 are threaded to receive half union type couplings 90. The half union couplings 90 provide easy connection to plumbing for the cold water inlet 50 and heated water outlet 60.

Figure 2:
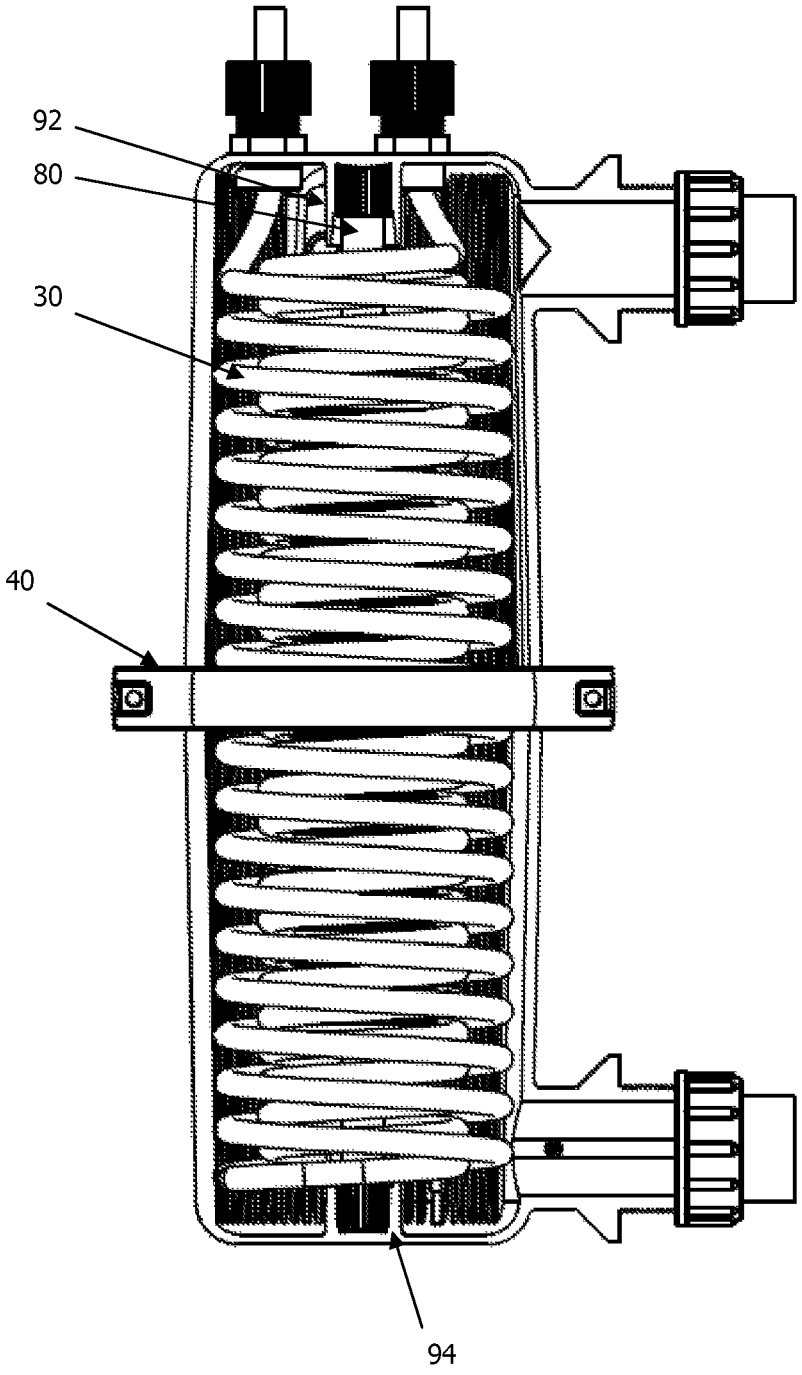
FIG. 2 is a front view of the heat exchanger of FIG. 1.

The interior of the moulded plastic casing halves 14, 15 further comprise abutment portions 92, 94 for holding a flow guide 80. As shown in FIG. 2, the flow guide 80 is supported by a first abutment portion 92 in the form of a first annular flange 92 which is formed inside the casing 12 at the proximal end 22, inside the first casing half 14, and a second abutment portion 94 in the form of a annular flange 94 which is also located inside the casing 12 at the distal end 24, inside the second casing half 15.

Figure 9:
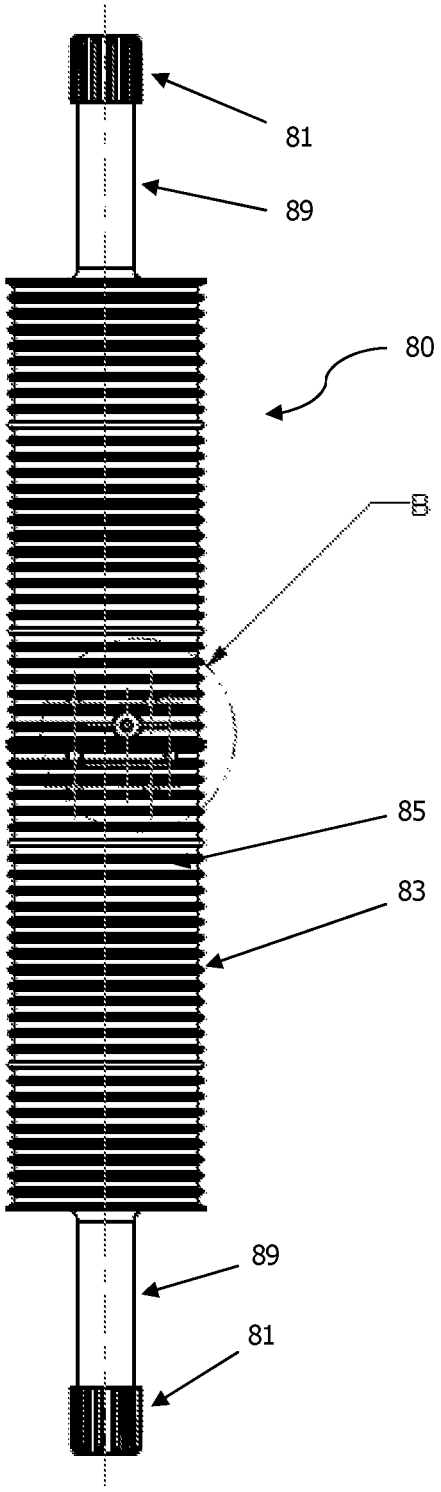
FIG. 9 is a front view of a flow guide of the heat exchanger of FIG. 1.

The flow guide 80 is shown in isolation in FIG. 9. The flow guide 80 includes a barrel 85 and a stem 89 located on two opposing sides of the barrel 85. The end of each stem 89 includes an engagement formation in the form of an external splined connection 81. The splined connections are adapted to mesh with the abutment portions 92, 94 within the casing 12, which include corresponding internal splines.

The flow guide 80 is located in the centre of the heat exchanger 10, within the centre of the inner coil 34. The flow guide 80 agitates the water, promoting turbulence within the water flowing through the cavity 13, which advantageously results increased contact with the coil tube 30 for improved heat exchange. As such, the flow guide 80 increases the flow path of the water over the internal 34 and external coil 32 of the coil tube 30 for maximum heat transfer.

Referring to FIG. 9, the flow guide 80 is defined by a generally cylindrical barrel 85 having a plurality of annular bands or alternatively a helically extending rib 83. The bands or ribs 83 are located around the circumference of the barrel 85, and extend in a direction which is generally perpendicular to the water flow direction through the heat exchanger 10. The ribs 83 provide texture on the outer flow guide 80 surface, and promote turbulence in the water, increasing the performance of the heat extraction process.

Figure 10:
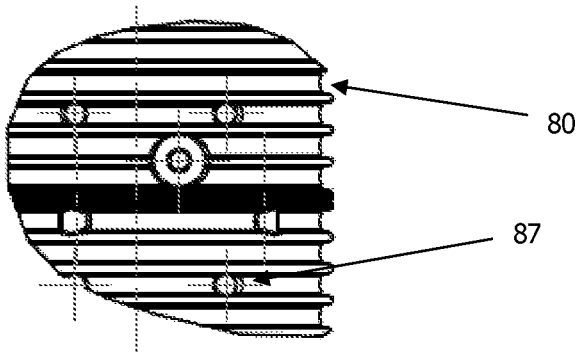
FIG. 10 is a detail showing a portion of the flow guide of FIG. 9.

The barrel 85 of the flow guide 80 has a hollow, internal chamber, and a plurality of openings 87 are located in the wall of the barrel 85. The openings 87 are in fluid communication with the internal hollow space located within the barrel 85. A detail showing a portion of the outer wall of the barrel 85 is shown in isolation in FIG. 10. The openings 87 permit water drainage which is useful especially during cold periods such as winter. During winter heat pumps are generally not used. Accordingly, the openings 87 enable the drainage of any water left in the flow guide 80, which reduces the risk of damage resulting from expansion of water when freezing occurs.

Figure 8:
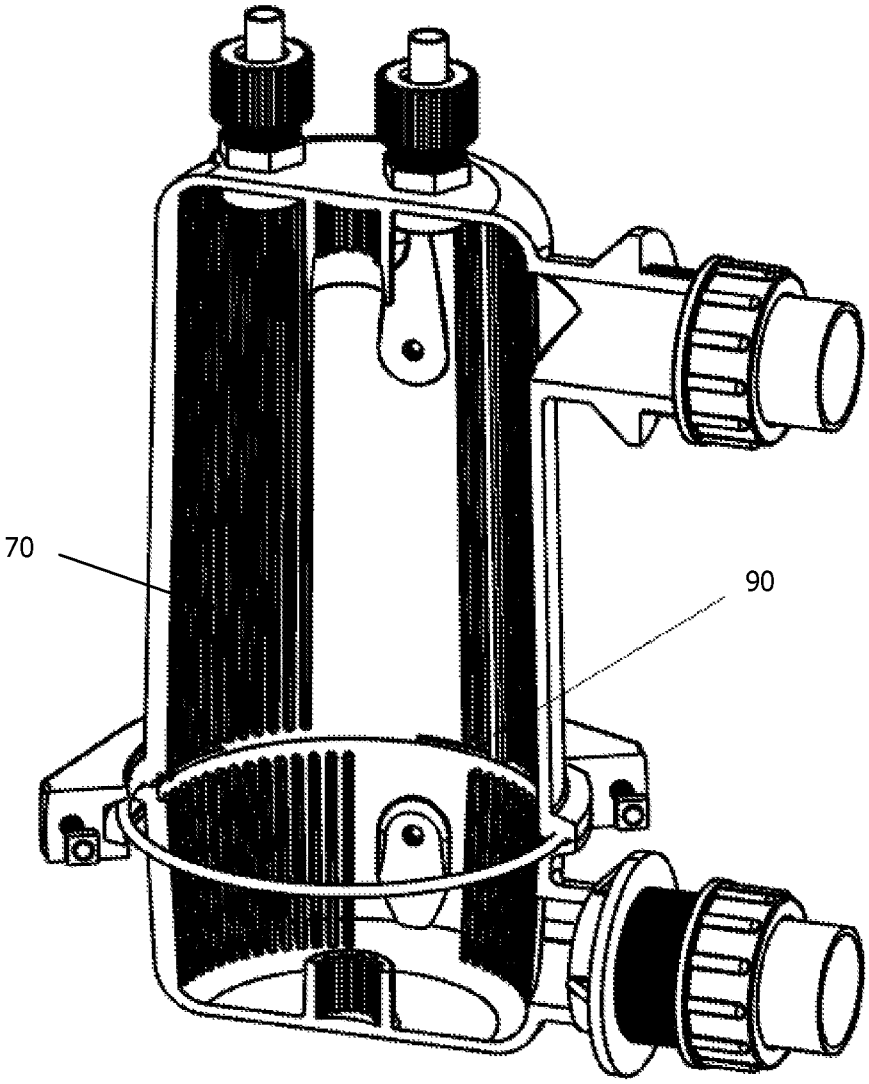
FIG. 8 is a perspective cross-sectional view depicting half of the heat exchanger casing of a second embodiment.

As shown in FIGS. 7 and 8, the internal walls of the casing 12 include a plurality of longitudinally extending ribs 70. The ribs 70 assist to guide the water passing through the heat exchanger 10 between the cold water inlet 50 and the heated water outlet 60.

The ribs 70 are cast into the wall of the casing 12 during manufacture, and extend away from the wall of the casing 12. However, it will be appreciated that longitudinally extending grooves or channels may be alternatively provided which can be cast or machined into the wall of the casing 12.

The heat exchanger 10 includes damping means 90 for limiting the movement of the coil tube 30. This reduces the amount of operating noise, and reduces the likelihood of cyclical damage resulting from vibration of the coil tube 30.

Figure 11:
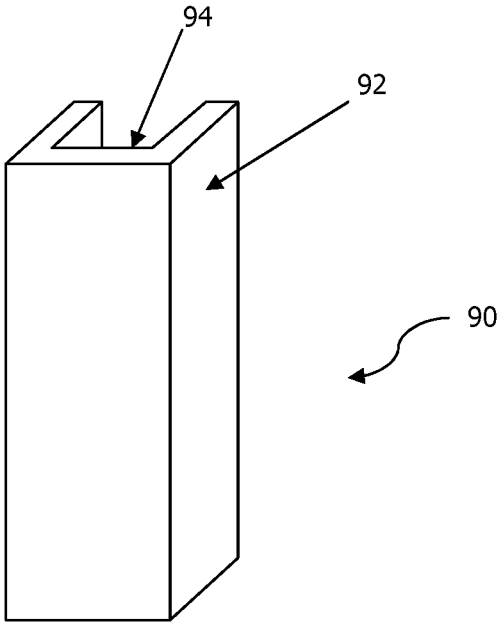
FIG. 11 depicts a damping means of the heat exchanger of FIGS. 1 and 8.

The damping means 90 is depicted in isolation in FIG. 11. The damping means 90 is a longitudinally extending generally U-shaped bar 90, which snaps into engagement, or otherwise loosely abuts against the inner wall of the casing 12, such that arms 92 of the bar 90 interact with spaces between the longitudinally extending ribs 70. The outer coil 32 of the coil tube 30 abuts against the central portion 94 of the U-shaped damping bar 90, and this limits the amount that the outer coil tube 32 can move or vibrate laterally when water flows through it. The number of damping bars provided 90 depends on the size of the heat exchanger 10. In some embodiments three damping bars 90 are provided, whilst in larger models of the heat exchanger 10, six or more damping bars 90 may be provided.

The damping bars 90 can be made from a polymeric materials or synthetic elastic materials such as plastic or rubber. The damping bars 90 extend between the proximal end 22 and the distal end 24 of the casing 12.

When water exits from the heat exchanger 10 through the outlet 60, the pool water has extracted some of the thermal energy contained within the working fluid source, and is hotter than the water at the inlet 50. The heated water is then returned to the pool, to locally raise the water temperature within the pool. In contrast the working fluid exiting the outlet 26 is subsequently at a lower temperature, and is returned to the heat source for further heating and subsequent recirculation through the heat exchanger 10.

Advantageously, the double coil 30 maximises heat exchange between the hot and cold water sources, by increasing the water contact surface area.

As shown in FIG. 1, a tube gland 112 manufactured from a moulded engineering plastic is located on each of the tube ends for sealing the inlet 20 and outlet 26 relative to the casing 12.

The embodiment of FIGS. 1 to 7 relate to a first size of the heat exchanger 10, in which the join between the casing halves 14, 15 is located approximately in the centre of the heat exchanger 10. In an alternative embodiment depicted in FIG. 8, the lower half 15 of the casing is smaller, such that the join between the upper and lower casing halves 14, 15 is located below the centre of the heat exchanger.

Figure 3:
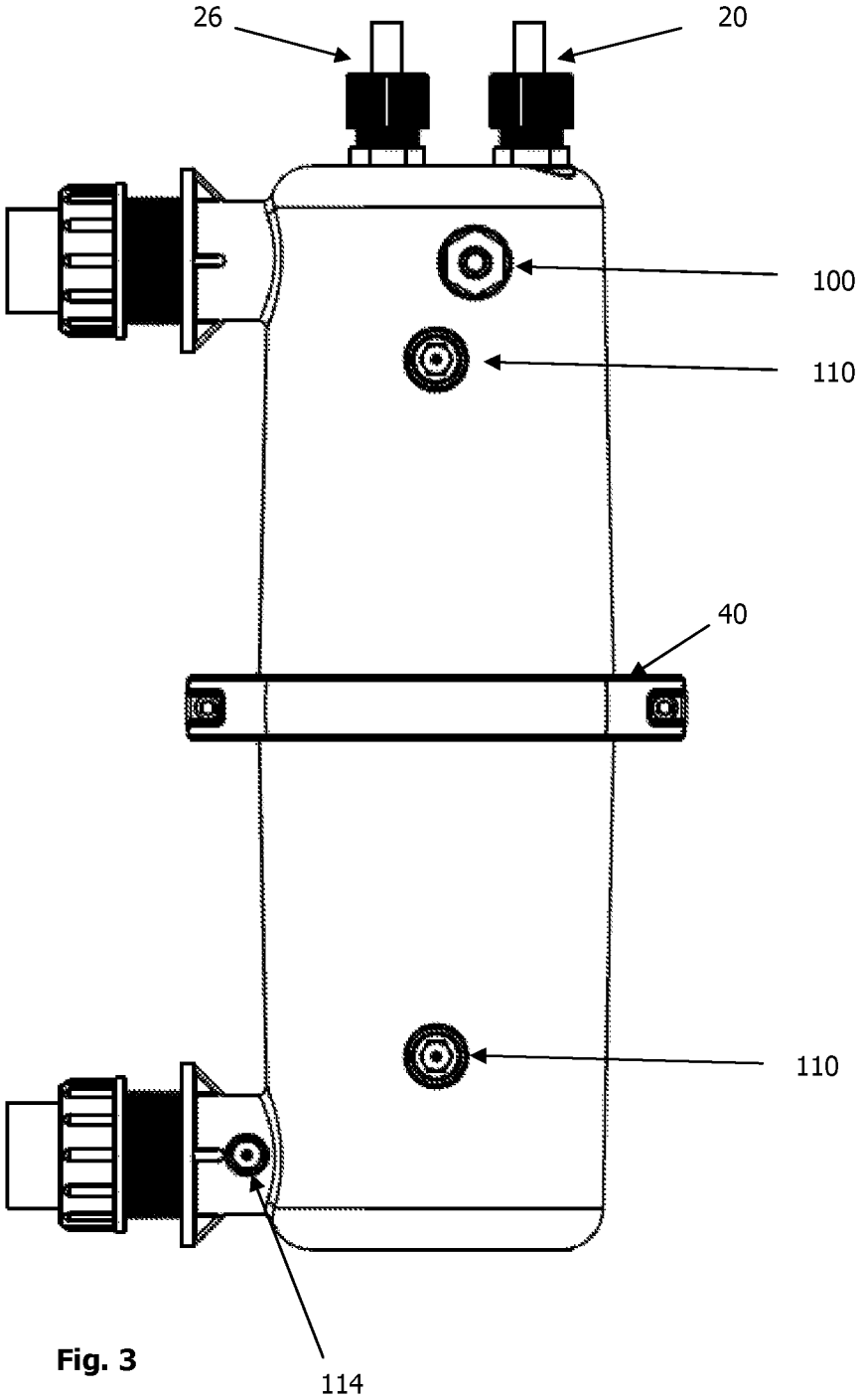
FIG. 3 is a rear view of the heat exchanger of FIG. 1.
Figure 4:
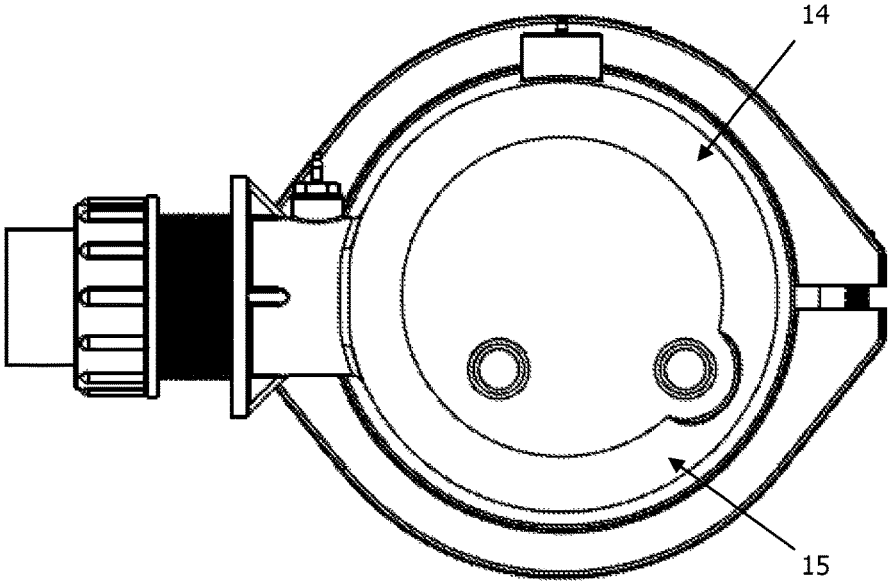
FIG. 4 is a bottom view of the heat exchanger of FIG. 3 depicted fully assembled.
Figure 5:
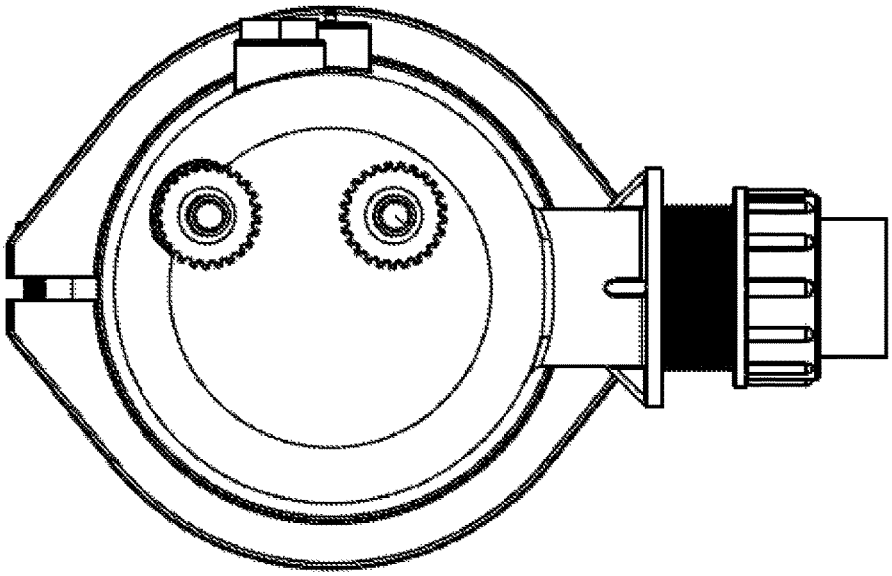
FIG. 5 is a top view of the heat exchanger of FIG. 4.
Figure 6:
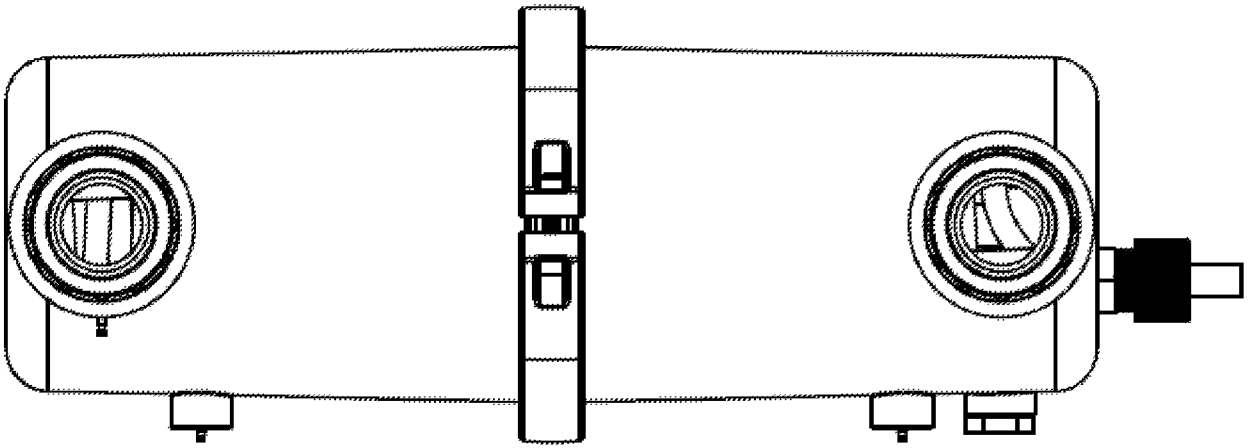
FIG. 6 is a right side view depicting the heat exchanger of FIG. 4.

FIG. 3 depicts a rear view of the heat exchanger 10. The pre-moulded casing 12 has a plurality of apertures. Two of the aperture are dedicated to allow the tube ends of the double row coil 30 to penetrate through the housing as shown in FIGS. 1 and 2. In addition other apertures are provided to receive two nipples 110 located externally on the casing 12 as shown in FIG. 3, and a further nipple 114 which is located on the water inlet 50.

In order to determine the temperature of water inside the casing 12, a thermowell temperature sensor 100 is provided on the heat exchanger 10 casing 12. The temperature sensor 100 senses the temperature of the water and activates an electronic circuit that is connected to the temperature sensor 100 when the temperature reaches a set point. For example, when a set temperature is reached, a compressor of a heating system will be switched off in order to stop a refrigerant from flowing through the double row coil 30.

The nipples 110 and/or 114 are connectable to a pressure switch for sensing and measuring water pressure. For example, when no water is flowing through the heat exchanger 10, the compressor will be switched off.

The assembly or re-assembly of the heat exchanger 10 will now be described. When a technician wishes to assemble the heat exchanger 10 for example during maintenance or repair, the coil tube 30 is re-connected if it was removed. The technician then inserts the flow guide 80, such that the external splined connection 81 located at one end of the flow guide 80 meshes with one of the abutment portions 92, 94 in one half 14 the casing 12. The O-ring 51 is then seated on one of the grooves located in one of the flanges 47. The other half of the casing 12 is then positioned such that the flow guide 80 passes through the centre of the inner coil 34.

As the two casing halves 14, 15 come into abutment, the external splined connection 81 at the opposing end of the flow guide meshes with the second half 15 of the casing 12, and the O-ring 51 becomes located between the two grooves.

The clamp members 42 are then located around the flanges 47 on the casing 12. The technician then tightens the bolts 46, to compress the O-ring 51 to a suitable degree to achieve a water tight seal. The heat exchanger 10 can be readily opened in a manner being the reverse of that described above for subsequent maintenance or repairs.

The design and the method of constructing the heat exchanger 10 permits the number of apertures or sensors to be increased or reduced according to requirement and the use of the sensors is not limited to temperature and flow sensors.

Although the invention has been described with reference to specific examples, it will be appreciated by those skilled in the art that the invention may be embodied in many other forms.

The claims defining the invention are as follows:

1. A heat exchanger comprising:

a housing;

a fluid flow conduit located within a cavity formed in the housing, the fluid flow conduit including an outer tube located adjacent to an inner wall of the housing and an inner tube in fluid communication with the outer tube, the inner tube being located between the outer tube and a longitudinal axis of the housing, the outer tube defines a first helix extending generally co-axially with the longitudinal axis and the inner tube defines a second helix extending generally co-axially with the longitudinal axis;

an inlet port located on the housing, the inlet port being in fluid communication with the cavity;

an outlet port located on the housing, the outlet port being in fluid communication with the cavity; and a flow guide located between the inner tube and the longitudinal axis of the housing, the flow guide being adapted to agitate water flowing between the inlet port and the outlet port, wherein the housing includes a first section and a second section that are selectively detachable relative to each other, wherein the flow guide includes two stems which are located at opposing ends of the flow guide, each stem including a first engagement formation for engaging with a corresponding second engagement formation formed in the housing, and wherein the first and second engagement formations are corresponding male and female spline connections.

2. The heat exchanger of claim 1, wherein the flow guide includes an elongate cylindrical member having a textured outer surface.

3. The heat exchanger of claim 2, wherein the textured outer surface includes a plurality of annular ribs or a helical rib.

4. The heat exchanger of claim 3, wherein the elongate cylindrical member is hollow and includes a plurality of apertures for permitting drainage of water.

5. The heat exchanger of claim 1, further comprising a plurality of longitudinally extending ribs or grooves formed on the inner wall of the housing.

6. The heat exchanger of claim 5, wherein the first and second sections each include an annular flange, the annular flange including a first side having an annular groove and an opposing second side having an inclined surface.

7. The heat exchanger of claim 6, wherein the housing includes a removable clamp for securing the first section to the second section.

8. The heat exchanger of claim 7, wherein the removable clamp has a generally U-shaped profile, defining two inclined arms, each arm being adapted to engage with one of the annular flange inclined surfaces, and wherein the removable clamp is adjustable to pull the first and second sections together to compress a gasket or O-ring.

9. The heat exchanger of claim 1, wherein the housing is manufactured from a glass fibre polypropylene.

10. The heat exchanger of claim 8, wherein the removable clamp includes two band portions which are securable together with fasteners.

11. The heat exchanger of claim 1, wherein the fluid flow conduit is manufactured from titanium.

12. The heat exchanger of claim 1, wherein the housing includes one or more apertures for receiving a temperature and/or pressure sensor.

13. The heat exchanger of claim 1, further comprising at least one damping means located between the inner wall of the housing and the outer tube.

14. The heat exchanger of claim 13, wherein the damping means includes an engagement formation adapted to engage with the inner wall, and wherein three or more damping means are spaced around a circumference of the cavity.

* * * * *